US009871303B2

(12) United States Patent
Chantz

(10) Patent No.: US 9,871,303 B2
(45) Date of Patent: Jan. 16, 2018

(54) MULTI-FREQUENCY, MULTI-RADIATION ANGLE, MULTI-POLARIZATION AND MULTI-PATTERN COMMUNICATION ANTENNA

(71) Applicant: International Business Machines Corporation, Armonk, NY (US)

(72) Inventor: Hyman D. Chantz, Scarsdale, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 49 days.

(21) Appl. No.: 15/164,380

(22) Filed: May 25, 2016

(65) Prior Publication Data

US 2017/0346196 A1 Nov. 30, 2017

(51) Int. Cl.

| | |
|---|---|
| ***H01Q 21/29*** | (2006.01) |
| ***H01Q 21/30*** | (2006.01) |
| ***H01Q 21/28*** | (2006.01) |
| ***H01Q 21/24*** | (2006.01) |
| ***H01Q 1/08*** | (2006.01) |
| ***H01Q 1/32*** | (2006.01) |
| ***H01Q 1/50*** | (2006.01) |

(52) U.S. Cl.

CPC ..... *H01Q 21/29* (2013.01); *H01Q 1/084* (2013.01); *H01Q 1/3275* (2013.01); *H01Q 1/50* (2013.01); *H01Q 21/245* (2013.01); *H01Q 21/28* (2013.01); *H01Q 21/30* (2013.01)

(58) Field of Classification Search

CPC ..... H01Q 1/084; H01Q 7/02; H01Q 21/24; H01Q 21/245; H01Q 21/28; H01Q 21/29; H01Q 21/30

USPC ..... 343/724, 725, 726, 727, 728

See application file for complete search history.

(56) References Cited

U.S. PATENT DOCUMENTS

| | | | | |
|---|---|---|---|---|
| 3,299,428 | A * | 1/1967 | Tessari, III | H01Q 21/29 343/743 |
| 4,433,336 | A | 2/1984 | Carr | |
| 9,225,063 | B2 | 12/2015 | Lee | |
| 2010/0231461 | A1 | 9/2010 | Tran | |
| 2010/0231471 | A1 | 9/2010 | Haglund | |
| 2013/0053713 | A1 * | 2/2013 | Albu | A61B 5/0006 600/509 |
| 2014/0002319 | A1 | 1/2014 | Lindenmeier et al. | |

(Continued)

FOREIGN PATENT DOCUMENTS

| | | | |
|---|---|---|---|
| CN | 204596978 | U | 8/2015 |
| FR | 2559623 | A1 | 8/1985 |

OTHER PUBLICATIONS

IBM et al. (1993). Enhanced Flat Loop Antenna. IBM TDB, 36(11), 417-418.

*Primary Examiner* — Robert Karacsony

(74) *Attorney, Agent, or Firm* — Cantor Colburn LLP

(57) ABSTRACT

An antenna is provided and includes a base antenna component, a loop antenna component, a first coupling by which the loop antenna component is pivotally attached to and selectively electrically communicative with the base antenna component, a whip antenna component, a second coupling by which the whip antenna component is pivotally attached to and selectively electrically communicative with the loop antenna component; and a transmission/reception (T/R) module. The T/R module is disposable in signal communication with at least one or more of the base, loop and whip antenna components.

20 Claims, 6 Drawing Sheets

(56) References Cited

U.S. PATENT DOCUMENTS

| | | | |
|---|---|---|---|
| 2014/0240185 | A1 | 8/2014 | Laurent |
| 2014/0266888 | A1 | 9/2014 | Parent |

* cited by examiner

MULTI-FREQUENCY, MULTI-RADIATION ANGLE, MULTI-POLARIZATION AND MULTI-PATTERN COMMUNICATION ANTENNA

BACKGROUND

The present invention relates to antennae and, more specifically, to antennae with multi-frequency, multi-radiation angle, multi-polarization and multi-pattern communication capabilities.

Radio frequency (RF) antennae are used in a wide variety of fixed, portable and mobile communications implementations. In many cases, such antennae are limited as to their radiation angle, their frequency band or their polarization angle with corresponding resulting limits as to their communications coverage capabilities.

In general, an "omni-directional" antenna provides moderately-effective coverage to all stations in its coverage area while a bi-directional or unidirectional antenna provides coverage which favors one or two areas. Thus, in high frequency (HF) bands of 3-30 MHz, a lower antenna radiation angle from a ground or vehicle mounted antenna may favor distant stations while a higher antenna radiation angle might favor more local stations. By contrast, in very high frequency (VHF) and ultra-high frequency (UHF) bands of 30-300 MHz, a lower antenna radiation angle from a tower-mounted antenna may favor nearer stations while a higher radiation angle might favor more distant stations.

SUMMARY

According to an embodiment of the present invention, an antenna is provided and includes a base antenna component, a loop antenna component, a first coupling by which the loop antenna component is pivotally attached to and selectively electrically communicative with the base antenna component, a whip antenna component, a second coupling by which the whip antenna component is pivotally attached to and selectively electrically communicative with the loop antenna component; and a transmission/reception (T/R) module. The T/R module is disposable in signal communication with at least one or more of the base, loop and whip antenna components.

According to another embodiment of the present invention, an antenna for attachment to a roof of a vehicle or fixed structure is provided. The antenna includes a base antenna component affixable to the roof of the vehicle or fixed structure, a loop antenna component, a first coupling by which the loop antenna component is pivotally attached to and selectively electrically communicative with the base antenna component, a whip antenna component, a second coupling by which the whip antenna component is pivotally attached to and selectively electrically communicative with the loop antenna component and a transmission/reception (T/R) module. The T/R module is disposable in signal communication with at least one or more of the base, loop and whip antenna components.

According to yet another embodiment of the present invention, an antenna array for attachment to an exterior surface of a vehicle or fixed structure is provided. The antenna array includes a plurality of antennae and a central control unit. Each antenna includes a base antenna component affixable to the exterior surface of the vehicle or fixed structure, a loop antenna component, a first coupling by which the loop antenna component is pivotally attached to and selectively electrically communicative with the base antenna component, a whip antenna component, a second coupling by which the whip antenna component is pivotally attached to and selectively electrically communicative with the loop antenna component, a transmission/reception (T/R) module and a central control unit. The T/R module is disposable in signal communication with at least one or more of the base, loop and whip antenna components. The central control unit is configured to control each of the first and second couplings and each of the T/R modules.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

As will be described below, an antenna is provided and offers multiple communications options with one physical implementation by integrating and combining advantages of at least three separate antenna types. These include, but are not limited to, directionally dis-continuative directly driven (DDRR) antennae, vertical loop antennae and vertical whip antenna. The antenna may be provided in five or more main configurations based on a given communications need at a given moment.

Figure 1:
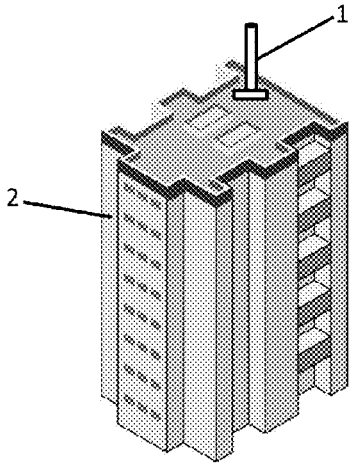
FIG. 1 is a schematic illustration of an antenna disposed on a roof of a fixed structure in accordance with embodiments.
Figure 2:
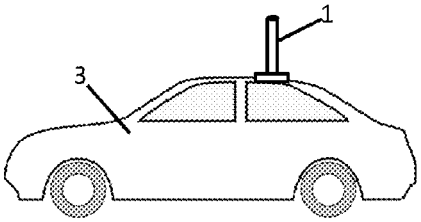
FIG. 2 is a schematic illustration of an antenna disposed on a roof of a vehicle in accordance with embodiments.

With reference to FIGS. 1 and 2, an antenna 1 is provided and may be operably disposed on a roof of a fixed structure 2, such as a building (see FIG. 1), or a vehicle 3, such as a car (see FIG. 2).

In any case, with reference to FIGS. 3-8, the antenna 1 may include a base antenna component 10, which may be a standalone component or integrated within the roof of the fixed structure 2 or the vehicle 3, a loop antenna component 20, a first coupling 30, a whip antenna component 40, a second coupling 50 and a transmission/reception (T/R) module 60. The loop antenna component 20 is pivotally attached to and selectively electrically communicative with the base antenna component 10 by way of the first coupling 30. The whip antenna component 40 is pivotally attached to and selectively electrically communicative with the loop antenna component 20 by way of the second coupling 50. The T/R module 60 may be located on or within the fixed structure 2 or the vehicle 3 and is disposable in signal communication with at least one or more of the base antenna component 10, the loop antenna component 20 and the whip antenna component 40 by way of at least one or more feedlines 70.

Each of the base antenna component 10, the loop antenna component 20 and the whip antenna component 40 may be formed of electrically conductive material, such as copper or another metallic or semi-conductive material. In any case, the base antenna component 10 may be formed into a planar component 11 that has a height dimension and length/width dimensions which are greater than the height dimension, the loop antenna component 20 may be formed into polygonal loop or rectangular loop and the whip antenna component 40 may be formed into an elongate member.

The first coupling 30 may be manually operable or manually or automatically operable with mechanical, magnetic, electrical or hydraulic assistance. That is, a pivoting of the loop antenna component 20 relative to the base antenna component 10 and/or a selection to make the loop antenna component 20 electrically communicative with the base antenna component 10 may each be performed manually or automatically at or by way of the first coupling 30 with or without mechanical, magnetic, electrical or hydraulic assistance.

The second coupling 50 may be manually operable or manually or automatically operable with mechanical, magnetic, electrical or hydraulic assistance. That is, a pivoting of the whip antenna component 40 relative to the loop antenna component 20 and/or a selection to make the whip antenna component 40 electrically communicative with the loop antenna component 20 may each be performed manually or automatically at or by way of the second coupling 50 with or without mechanical, magnetic, electrical or hydraulic assistance.

Figure 3:
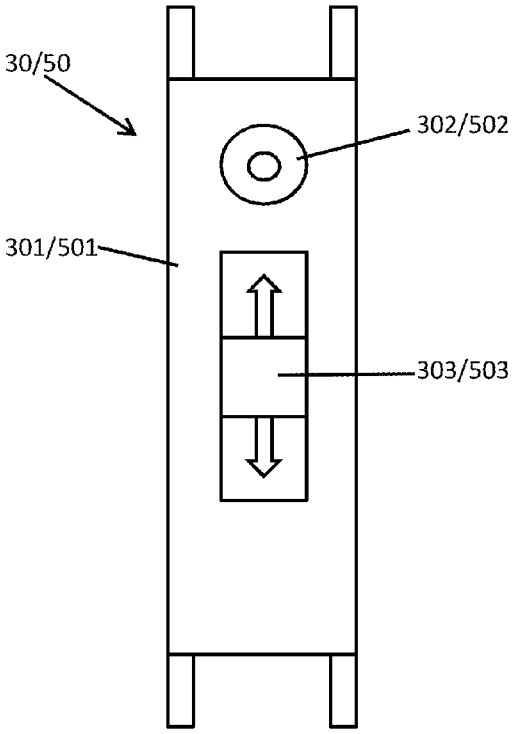
FIG. 3 is a side view of a first or second coupling for connecting antenna components in accordance with embodiments.

In accordance with embodiments and, with reference to FIG. 3, one or both of the first and second couplings 30 and 50 may include a body 301/501 with first and second ends, a feedline plug 302/502 and a switch element 303/503.

For the first coupling 30, the first end of the body 301 may be rotatably connectable with the base antenna component 10 and the second end of the body 301 may be rotatably connectable with the loop antenna component 20. As such, the loop antenna component 20 is pivotable relative to the base antenna component 10 to assume and move between various angles such as 0°, 90° and 180°. The feedline plug 302 is receptive of the one or more feedlines 70 and the switch element 303 is selectively controllable to electrically connect the loop antenna component 20 to the base antenna component 10 or to disconnect and electrically isolate those features from one another.

For the second coupling 50, the first end of the body 501 may be rotatably connectable with the loop antenna component 20 and the second end of the body 501 may be rotatably connectable with the whip antenna component 40. As such, the whip antenna component 40 is pivotable relative to the loop antenna component 20 to assume and move between various angles such as 0°, 90° and 180°. The feedline plug 502 is receptive of the one or more feedlines 70 and the switch element 503 is selectively controllable to electrically connect the whip antenna component 40 to the loop antenna component 20 or to disconnect and electrically isolate those features from one another.

Each of the one or more feedlines 70 may be provided as a coaxial cable. In such cases, each of the one or more feedlines 70 may have an inner (or center) conductor, an outer conductor (or shield) surrounding the inner conductor, dielectric material interposed between the inner conductor and the outer conductor and dielectric material surrounding the outer conductor.

With the above-described structural features, the antenna 10 can be provided in multiple configurations. A selection of these multiple configurations will be discussed below.

Figure 4:
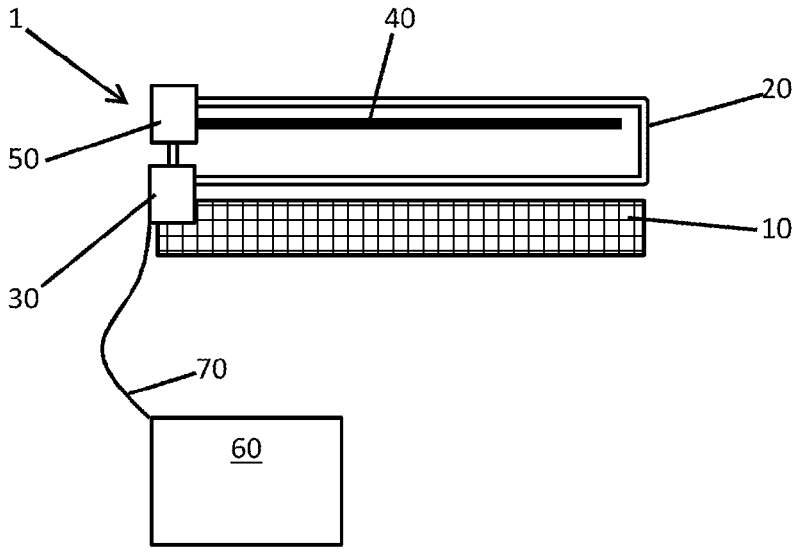
FIG. 4 is a schematic illustration of the antenna of FIG. 1 or FIG. 2 in a first configuration.

In a first configuration, as shown in FIG. 4, the antenna 10 is provided as a directionally dis-continuative directly driven (DDRR) antenna. In this case, the base antenna component 10 lies horizontally, the loop antenna component 20 is pivoted about the first coupling 30 to lie horizontally along an upper surface of the base antenna component 10 and the whip antenna component 40 is pivoted about the second coupling 50 to lie horizontally with the loop antenna component 20. In addition, the second coupling 50 is selectively structured or configured to electrically connect the whip antenna component 40 with the loop antenna component 20 with a single feedline 70 being provided. Of this single feedline 70, the inner conductor is electrically communicative with the loop antenna component 20 directly or by way of the first coupling 30 and the outer conductor is electrically communicative with the base antenna component 10.

The first configuration may be particularly useful for multi-frequency and low-angle of incidence communications where the antenna 1 is disposed in a location in which space is restricted. For example, if the antenna 1 is provided on a roof of a vehicle 3 as in FIG. 2 and the vehicle 3 is parked in a garage, an operator might want to place the antenna 1 in the first configuration in order to save space while still permitting executions of multi-frequency and low-angle of incidence communications.

Figure 5:
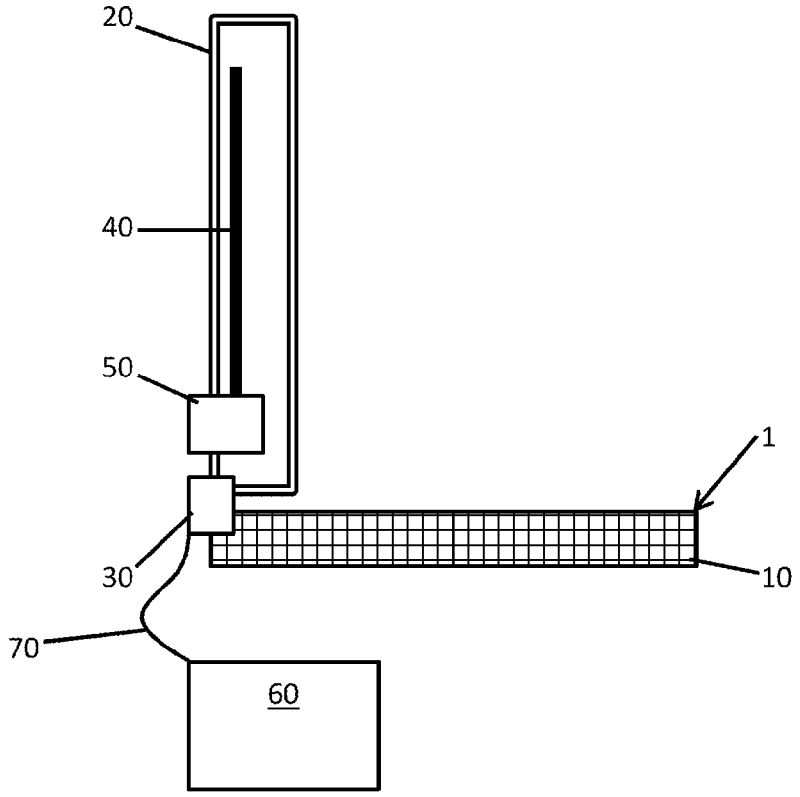
FIG. 5 is a schematic illustration of the antenna of FIG. 1 or FIG. 2 in a second configuration.

In a second configuration, as shown in FIG. 5, the antenna 10 is provided as a bi-directional vertically polarized antenna or a "vertical loop" antenna. In this case, the base antenna component 10 lies horizontally, the loop antenna component 20 is pivoted about the first coupling 30 to assume a vertical orientation relative to an upper surface of the base antenna component 10 and the whip antenna component 40 is pivoted about the second coupling 50 to assume a vertical orientation that overlaps with the loop antenna component 20. In addition, the second coupling 50 is selectively structured or configured to electrically connect the whip antenna component 40 with the loop antenna component 20 with a single feedline 70 being provided. Of this single feedline 70, the inner conductor is electrically communicative with a first side of the loop antenna component 20 and the outer conductor is electrically communicative with a second side of the loop antenna component 20.

The second configuration may be employed for very high frequency (VHF) and ultra-high frequency (UHF) communications with both front and back signal propagation requirements. This is particularly true where the frequency of the VHF/UHF communications is at or near the natural resonant frequency of the loop antenna component 20 (the loop antenna component 20 is responsible for most of the signal transmission/reception in this case), which is related to the circumference of the loop.

Figure 6:
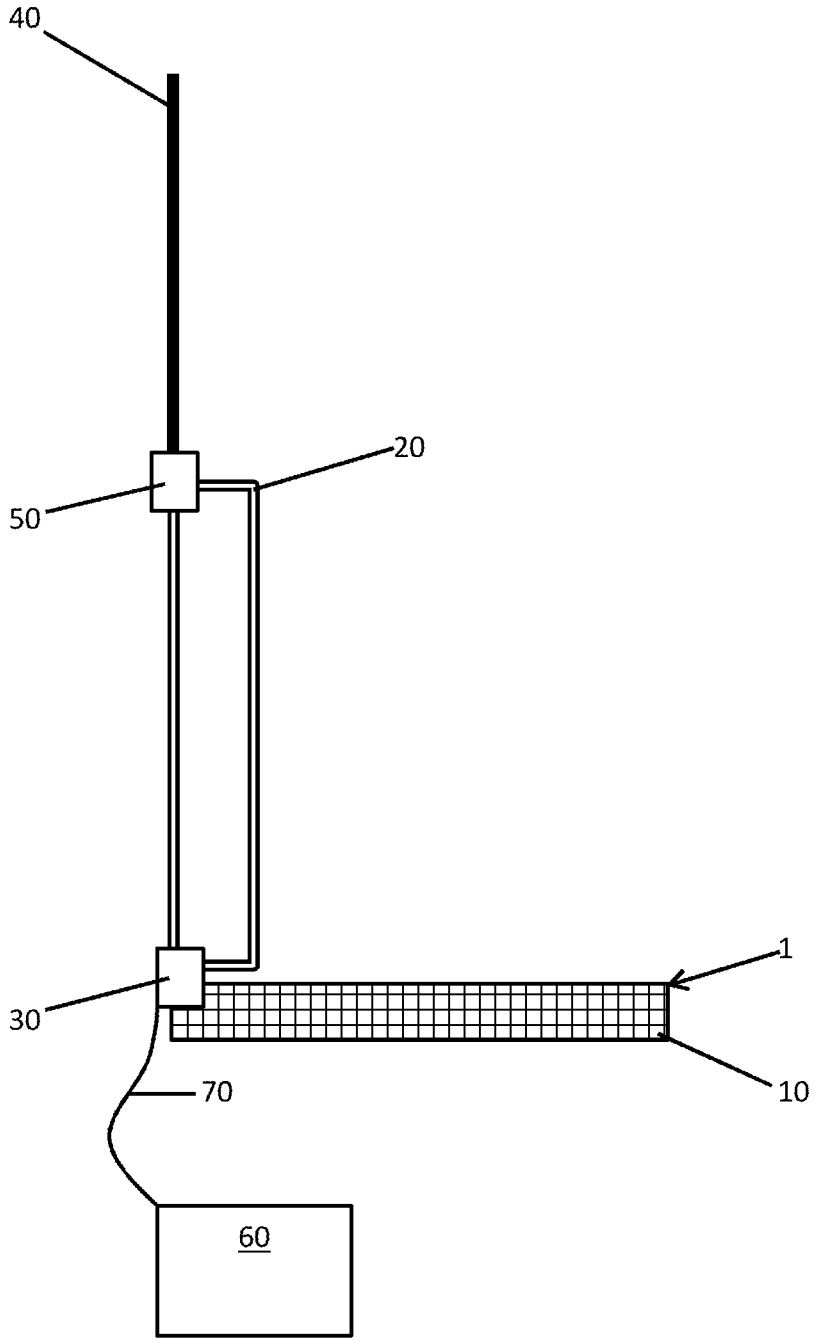
FIG. 6 is a schematic illustration of the antenna of FIG. 1 or FIG. 2 in a third configuration.

In a third configuration, as shown in FIG. 6, the antenna 10 is provided as an omni-directional vertically polarized antenna or an "extended whip" antenna. In this case, the base antenna component 10 lies horizontally, the loop antenna component 20 is pivoted about the first coupling 30 to assume a vertical orientation relative to an upper surface of the base antenna component 10 and the whip antenna component 40 is pivoted about the second coupling 50 to assume a vertical orientation that extends upwardly from an uppermost end of the loop antenna component 20. In addition, the second coupling 50 is selectively structured or configured to electrically connect the whip antenna component 40 with the loop antenna component 20 with a single feedline 70 being provided. Of this single feedline 70, the inner conductor is electrically communicative with the loop antenna component 20 directly or by way of the first coupling 30 and the outer conductor is electrically communicative with the base antenna component 10.

The third configuration may be employed for very high frequency (VHF) and ultra-high frequency (UHF) communications with both front and back signal propagation requirements and effectively doubles a size of the whip antenna component 40. This is particularly true where the frequency of the VHF/UHF communications is at or near the natural resonant frequency of the antenna, which is related to a multiple of a combined height of the loop antenna component 20 and the whip antenna component 40. The operational frequency of the third configuration is thus twice the operational frequency of the second configuration.

Figure 7:
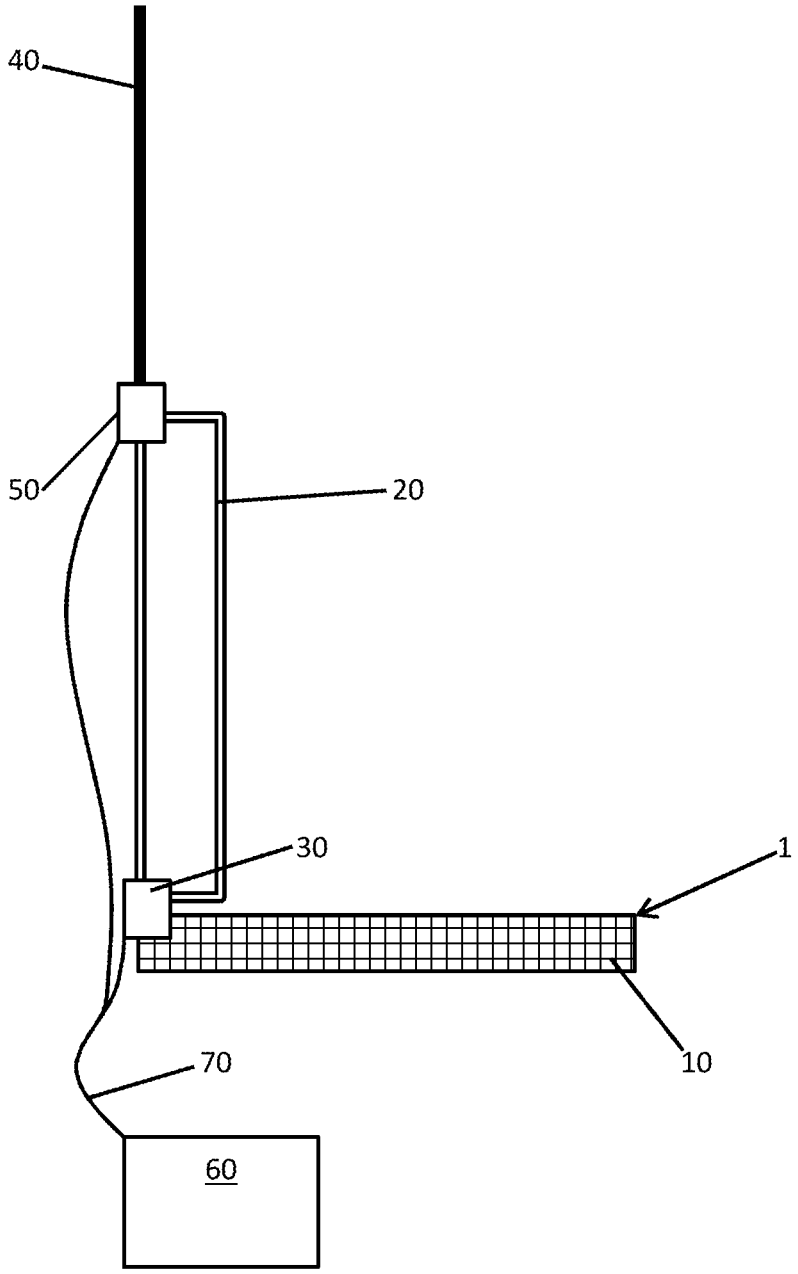
FIG. 7 is a schematic illustration of the antenna of FIG. 1 or FIG. 2 in a fourth configuration.

In a fourth configuration, as shown in FIG. 7, the antenna 10 is provided as an omni-directional vertically polarized antenna or a "high whip" antenna. In this case, the base antenna component 10 lies horizontally, the loop antenna component 20 is pivoted about the first coupling 30 to assume a vertical orientation relative to an upper surface of the base antenna component 10 and the whip antenna component 40 is pivoted about the second coupling 50 to assume a vertical orientation that extends upwardly from an uppermost end of the loop antenna component 20. Here, the second coupling 50 is selectively structured or configured to electrically isolate or disconnect the whip antenna component 40 from the loop antenna component 20 with a single feedline 70 being provided. Of this single feedline 70, the inner conductor is electrically communicative with the whip antenna component 40 directly or by way of the second coupling 50 and the outer conductor is electrically communicative with the base antenna component 10.

The fourth configuration may be employed for very high frequency (VHF) and ultra-high frequency (UHF) communications with extended local coverage.

Figure 8:
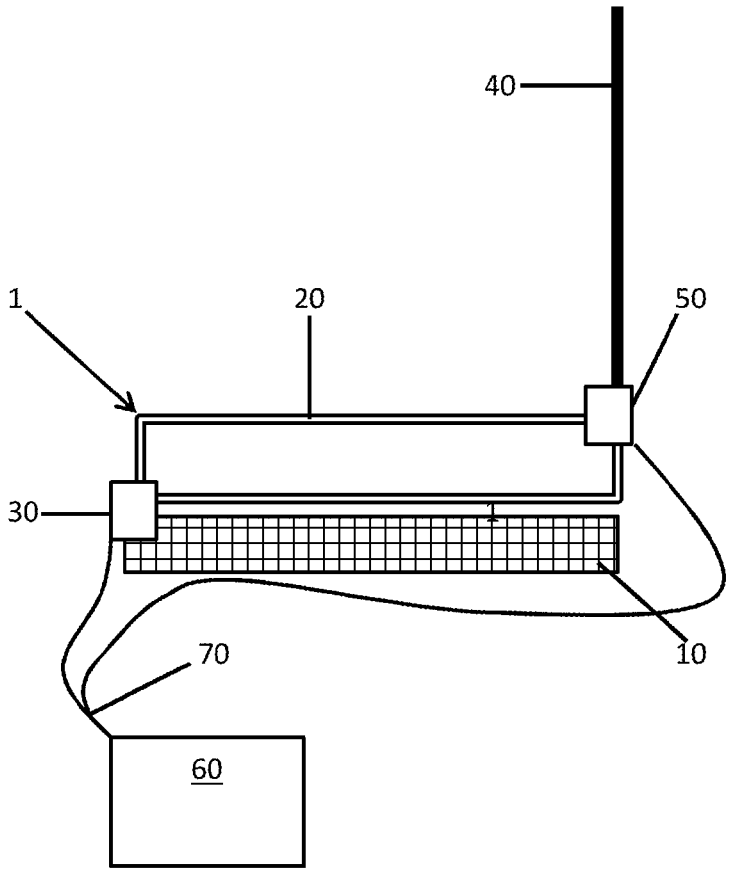
FIG. 8 is a schematic illustration of the antenna of FIG. 1 or FIG. 2 in a fifth configuration.

In a fifth configuration, as shown in FIG. 8, the antenna 10 is provided as an omni-directional vertically polarized antenna or a "low whip" antenna. In this case, the base antenna component 10 lies horizontally, the loop antenna component 20 is pivoted about the first coupling 30 to lie horizontally along an upper surface of the base antenna component 10 and the whip antenna component 40 is pivoted about the second coupling 50 to assume a vertical orientation relative to the base antenna component 10 and the whip antenna component 20. Here, the second coupling 50 is selectively structured or configured to electrically isolate or disconnect the whip antenna component 40 from the loop antenna component 20 with a single feedline 70 being provided. Of this single feedline 70, the inner conductor is electrically communicative with the whip antenna component 40 directly or by way of the second coupling 50 and the outer conductor is electrically communicative with the base antenna component 10.

The fifth configuration may be employed for normalized local coverage and is often used with police cars.

Figure 9:
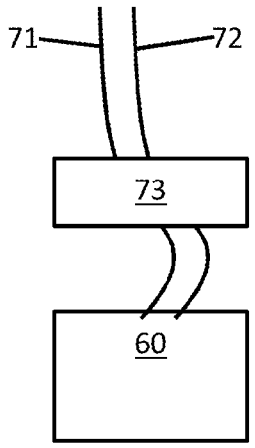
FIG. 9 is a schematic illustration of a feedline control unit of the antenna of FIG. 1 or FIG. 2 in accordance with embodiments.

With reference to FIG. 9, other configurations exist in which two feedlines 70 are provided. As shown in FIG. 9, in such configurations, a first feedline 71 might feed the loop antenna component 20, a second feedline 72 might feed the whip antenna component 40 and the antenna 1 may include a feedline control unit 73 that is operably disposed as a component of the T/R module 60 or as a standalone component between the T/R module 60 and the loop antenna component 20 and the whip antenna component 40. In any case, the feedline control unit 73 would be configured to control respective operations of the first and second feedlines 71 and 72.

As an example of such control, the feedline control unit 73 may be configured such that the first and second feedlines 71 and 72 independently feed the loop antenna component 20 and the whip antenna component 40 with signals of similar frequency and varying phases. Here, a phase angle of the signals carried by the first and second feedlines 71 and 72 could be shifted via antenna tuners and/or an inductor capacitance network with the antenna 1 thus becoming in effect a phased array that could potentially optimize certain coverage capabilities.

As an alternative example of control, the feedline control unit 73 may be configured such that the first and second feedlines 71 and 72 independently feed the loop antenna component 20 and the whip antenna component 40 with signals of varying frequencies. Here, one frequency could be (among many choices) the natural resonant frequency of the whip antenna component (e.g., 300/4×a length of the whip antenna component in MHz) and the other being related to the circumference of the loop antenna component 20. In this case, the feedline control unit 73 may be provided in particular as an antenna tuner that allows for a wide range of frequencies to be transmitted on both the first and second feedlines 71 and 72.

Figure 10:
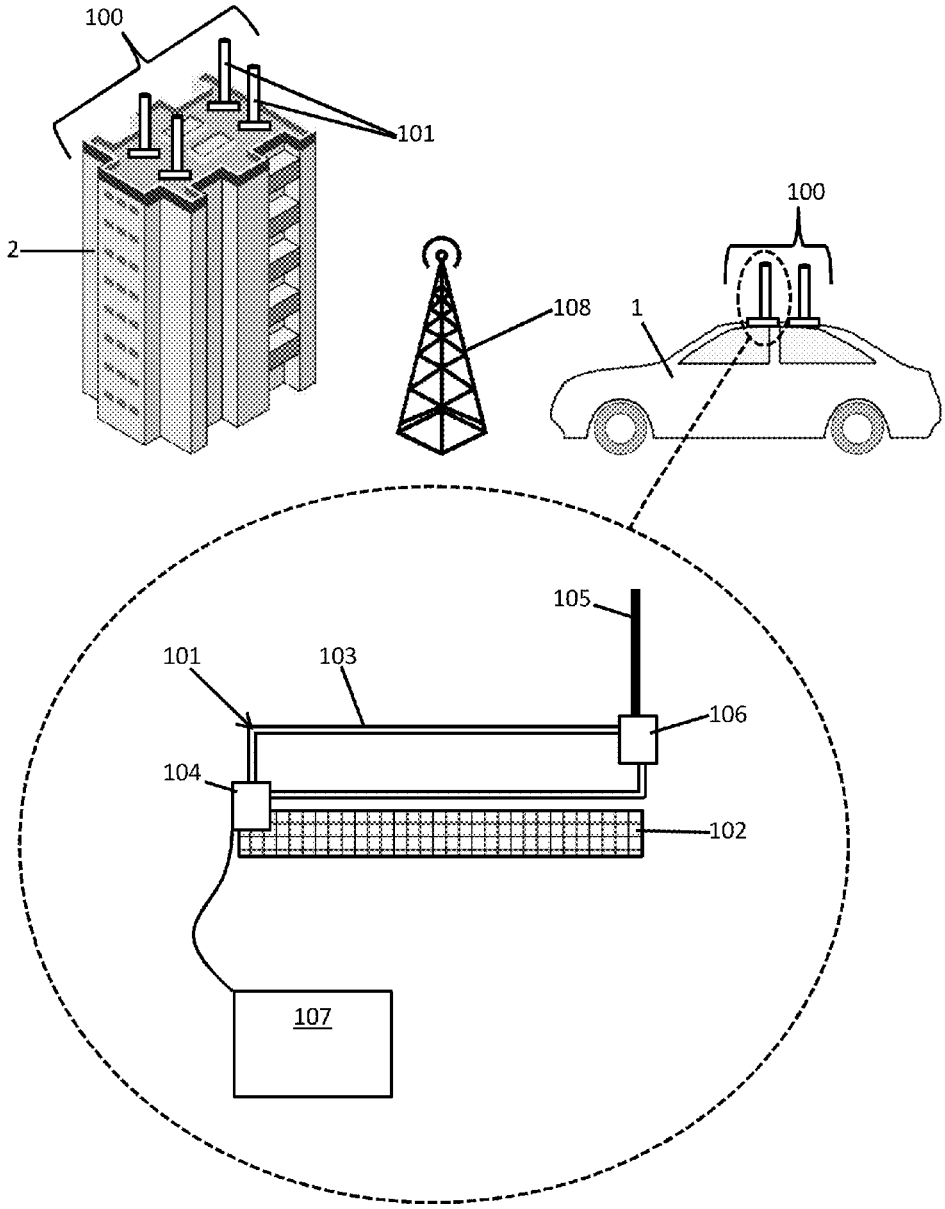
FIG. 10 is a schematic illustration of an antenna array in accordance with embodiments.

In accordance with further embodiments and, with reference to FIG. 10, an antenna array 100 may be provided for attachment to an exterior surface (or surfaces) of the fixed structure 2 of FIG. 1 or the vehicle 3 of FIG. 2. The antenna array 100 includes a plurality of antennae 101 that are constructed in a similar fashion as the antenna 1 described above. Thus, each of the plurality of antennae 101 includes a base antenna component 102 that is affixable to a local portion of the exterior surface of the fixed structure 2 or the vehicle 3, a loop antenna component 103, a first coupling 104 by which the loop antenna component 103 is pivotally attached to and selectively electrically communicative with the base antenna component 102, a whip antenna component 105, a second coupling 106 by which the whip antenna component 105 is pivotally attached to and selectively electrically communicative with the loop antenna component 103, a T/R module 107 and a central control unit 108. The T/R module 107 is disposable in signal communication with at least one or more of the base antenna components 102, the loop antenna components 103 and the whip antenna components 105 of each of the antennae 101 in a similar manner as described above. The central control unit 108 is configured to control each of the first and second couplings 104 and 106 and each of the T/R modules 107 of each of the antennae 101.

By way of the central control unit 108, the antenna array 100 could be used for multiple frequency communications, including UHF and extremely high frequency (EHF) communications of 300 MHz and higher. Moreover, the central control unit 108 can control the various angles between the whip antenna components 105 and the loop antenna components 103 and between the loop antenna components 103 and the base antenna components 102 of each of the antennae 101 such that the various angles could be vrapidly changed (e.g., by magnetic, thermal or micro-electromagnetic (MEMS) modalities). Since the central control unit 108 can also control the feedlines for each of the antennae 101, the antenna array 100 as a whole may be able to quickly scan and slew a beam for radar, satellite or secure communications.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An antenna, comprising:
a base antenna component;
a loop antenna component;
a first coupling by which the loop antenna component is pivotally attached to and selectively electrically communicative with the base antenna component;
a whip antenna component;
a second coupling by which the whip antenna component is pivotally attached to and selectively electrically communicative with the loop antenna component; and
a transmission/reception (T/R) module which is disposable in signal communication with at least one or more of the base, loop and whip antenna components.

2. The antenna according to claim 1, wherein:
the base antenna component comprises electrically conductive material formed into a planar component,
the loop antenna component comprises electrically conductive material formed into polygonal loop, and
the whip antenna component comprises electrically conductive material formed into an elongate member.

3. The antenna according to claim 1, wherein the first and second couplings are manually operable.

4. The antenna according to claim 1, wherein the first and second couplings are mechanically, magnetically, electrically or hydraulically operable.

5. The antenna according to claim 1, further comprising at least one or more feedlines connected between the T/R module and the base, loop and whip antenna components.

6. The antenna according to claim 1, further comprising:
a first feedline feeding the loop antenna component;
a second feedline feeding the whip antenna component; and
a feedline control unit configured to control respective operations of the first and second feedlines.

7. The antenna according to claim 6, wherein the feedline control unit is configured such that the first and second feedlines independently feed the loop and whip antenna components with signals of similar frequency and varying phases.

8. The antenna according to claim 6, wherein the feedline control unit is configured such that the first and second feedlines independently feed the loop and whip antenna components with signals of varying frequencies.

9. The antenna according to claim 1, wherein respective angles between the base antenna component and the loop antenna component and between the loop antenna component and the whip antenna component are at least 0°, 90° and 180°.

10. The antenna according to claim 1, wherein respective angles between the base antenna component and the loop antenna component and between the loop antenna component and the whip antenna component are variable.

11. An antenna for attachment to a roof of a vehicle or fixed structure, the antenna comprising:
a base antenna component affixable to the roof of the vehicle or fixed structure;
a loop antenna component;
a first coupling by which the loop antenna component is pivotally attached to and selectively electrically communicative with the base antenna component;
a whip antenna component;
a second coupling by which the whip antenna component is pivotally attached to and selectively electrically communicative with the loop antenna component; and
a transmission/reception (T/R) module which is disposable in signal communication with at least one or more of the base, loop and whip antenna components.

12. An antenna array for attachment to an exterior surface of a vehicle or fixed structure, the antenna array comprising:
a plurality of antennae that each comprise:
a base antenna component affixable to the exterior surface of the vehicle or fixed structure;
a loop antenna component;
a first coupling by which the loop antenna component is pivotally attached to and selectively electrically communicative with the base antenna component;
a whip antenna component;
a second coupling by which the whip antenna component is pivotally attached to and selectively electrically communicative with the loop antenna component;
a transmission/reception (T/R) module which is disposable in signal communication with at least one or more of the base, loop and whip antenna components; and
a central control unit configured to control each of the first and second couplings and each of the T/R modules.

13. The antenna array according to claim 12, wherein:
each base antenna component comprises electrically conductive material formed into a planar component,
each loop antenna component comprises electrically conductive material formed into polygonal loop, and
each whip antenna component comprises electrically conductive material formed into an elongate member.

14. The antenna array according to claim 12, wherein each of the first and second couplings are mechanically, magnetically, electrically or hydraulically operable.

15. The antenna array according to claim 12, further comprising at least one or more feedlines connected between each T/R module and the corresponding base, loop and whip antenna components.

16. The antenna array according to claim 12, further comprising:
first feedlines feeding each loop antenna component; and
second feedlines feeding each whip antenna component,
wherein respective operations of the first and second feedlines are controllable by the central control unit.

17. The antenna array according to claim 16, wherein the central control unit controls the first and second feedlines to independently feed the corresponding loop and whip antenna components with signals of similar frequency and varying phases.

18. The antenna array according to claim 16, wherein the central control unit controls the first and second feedlines to independently feed the corresponding loop and whip antenna components with signals of varying frequencies.

19. The antenna array according to claim 12, wherein respective angles between each base antenna component and each loop antenna component and between each loop antenna component and each whip antenna component are at least 0°, 90° and 180°.

20. The antenna array according to claim 12, wherein respective angles between each base antenna component and each loop antenna component and between each loop antenna component and each whip antenna component are variable.

* * * * *